US011725326B2

(12) United States Patent
Aurora et al.

(10) Patent No.: US 11,725,326 B2
(45) Date of Patent: Aug. 15, 2023

(54) FABRIC CLEANING APPLIANCE WITH PERFORMANCE ENHANCEMENT SELECTOR

(71) Applicant: WHIRLPOOL CORPORATION, Benton Harbor, MI (US)

(72) Inventors: Amberdeep S. Aurora, Saint Joseph, MI (US); Michael J. Bauman, Saint Joseph, MI (US); Donald Erickson, Stevensville, MI (US); Sarah E. Ihne, Stevensville, MI (US); Nicholas Leep, Saint Joseph, MI (US); Karl David McAllister, Stevensville, MI (US); Daniel Polonsky, Stevensville, MI (US); Ryan James Van Zoest, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 77 days.

(21) Appl. No.: 17/213,696

(22) Filed: Mar. 26, 2021

(65) Prior Publication Data

US 2021/0214873 A1 Jul. 15, 2021

Related U.S. Application Data

(62) Division of application No. 15/977,278, filed on May 11, 2018, now Pat. No. 10,988,881.

(Continued)

(51) Int. Cl.

*D06F 33/00* (2020.01)
*D06F 39/02* (2006.01)

(Continued)

(52) U.S. Cl.

CPC ..... *D06F 34/30* (2020.02); *D06F 33/00* (2013.01); *D06F 33/37* (2020.02); *D06F 34/18* (2020.02);

(Continued)

(58) Field of Classification Search

CPC ..... D06F 39/028; D06F 34/22; D06F 34/30; D06F 33/37; D06F 33/00; D06F 34/18;

(Continued)

(56) References Cited

U.S. PATENT DOCUMENTS 3,479,845 A * 11/1969 Engebretsen ..... D06F 39/02 68/17 R
6,434,977 B1 8/2002 Hapke et al.

(Continued)

FOREIGN PATENT DOCUMENTS

DE 10236935 A1 2/2004
DE 102007024437 A1 11/2008

(Continued)

OTHER PUBLICATIONS

Metal Flat Ring Illuminated Blue LED Push Button Self-Locking Switch 16MM By Hexie Electronic Technology Co., Ltd., https://www.alibaba.com/product-detail/Metal-Flat-Ring-illuminated-Blue-Led_60587240876.html, Accessed May 10, 2018.

(Continued)

*Primary Examiner* — Benjamin L Osterhout
(74) *Attorney, Agent, or Firm* — McGarry Bair PC

(57) ABSTRACT

A method of operating a laundry treating appliance having a tub, a rotatable drum at least partially defining a treating chamber, and a treating chemistry dispenser comprising multiple treating chemistry cups configured to dispense treating chemistry to the treating chamber. The method comprises performing a first wash cycle and dispensing a first dose of treating chemistry from one of the treating (Continued)

chemistry cups, receiving at a controller a user selection of an activation of a performance enhancement selector, and upon activation of the performance enhancement selector, activating a second wash cycle comprising dispensing a second dose of treating chemistry from another of treating chemistry cups.

20 Claims, 7 Drawing Sheets

Related U.S. Application Data

(60) Provisional application No. 62/529,210, filed on Jul. 6, 2017.

(51) Int. Cl.

| | |
|---|---|
| ***D06F 34/18*** | (2020.01) |
| ***D06F 34/22*** | (2020.01) |
| ***D06F 34/28*** | (2020.01) |
| ***D06F 34/30*** | (2020.01) |
| ***D06F 33/37*** | (2020.01) |
| *D06F 103/42* | (2020.01) |
| *D06F 103/68* | (2020.01) |
| *D06F 105/42* | (2020.01) |
| *D06F 101/20* | (2020.01) |
| *D06F 103/16* | (2020.01) |
| *D06F 101/04* | (2020.01) |

(52) U.S. Cl.
CPC ..... *D06F 34/22* (2020.02); *D06F 34/28* (2020.02); *D06F 39/028* (2013.01); *D06F 39/02* (2013.01); *D06F 2101/04* (2020.02); *D06F 2101/20* (2020.02); *D06F 2103/16* (2020.02); *D06F 2103/42* (2020.02); *D06F 2103/68* (2020.02); *D06F 2105/42* (2020.02)

(58) Field of Classification Search
CPC .. D06F 34/28; D06F 2105/42; D06F 2103/68; D06F 2101/20; D06F 2103/42; D06F 39/02; D06F 2103/16; D06F 2101/04
See application file for complete search history.

(56) References Cited

U.S. PATENT DOCUMENTS

| | | | | |
|---|---|---|---|---|
| 7,784,310 | B1 | 8/2010 | Bradford et al. | |
| 7,900,486 | B2 | 3/2011 | Richman et al. | |
| 7,941,885 | B2 | 5/2011 | Wong et al. | |
| 7,950,088 | B2 | 5/2011 | Dalton et al. | |
| 7,977,295 | B2 | 7/2011 | Classen | |
| 8,101,562 | B2 | 1/2012 | Classen | |
| 8,196,441 | B2 | 6/2012 | Hendrickson et al. | |
| 8,286,288 | B2 | 10/2012 | McAllister et al. | |
| 8,388,695 | B2 | 3/2013 | Hendrickson et al. | |
| 8,397,328 | B2 | 3/2013 | Hendrickson et al. | |
| 8,397,544 | B2 | 3/2013 | Hendrickson | |
| 8,438,881 | B2 | 5/2013 | Ihne et al. | |
| 8,615,834 | B2 | 12/2013 | McAllister et al. | |
| 8,650,917 | B2 | 2/2014 | McAllister et al. | |
| 8,752,405 | B2 | 6/2014 | Kim et al. | |
| 8,813,526 | B2 | 8/2014 | Doyle et al. | |
| 8,950,882 | B2 | 2/2015 | Park | |
| 8,997,289 | B2 | 4/2015 | Bang et al. | |
| 9,003,588 | B2 | 4/2015 | Amos et al. | |
| 9,086,216 | B2 | 7/2015 | Park | |
| 9,093,233 | B2 | 7/2015 | Kim et al. | |
| 9,127,390 | B2 | 9/2015 | Kim et al. | |
| 9,271,627 | B2 | 3/2016 | Alexander et al. | |
| 9,340,918 | B2 | 5/2016 | Lv et al. | |
| 9,416,482 | B2 | 8/2016 | Alexander et al. | |
| 9,445,704 | B2 | 9/2016 | McAllister et al. | |
| 10,988,881 | B2 * | 4/2021 | Aurora | D06F 39/028 |
| 2007/0084000 | A1 | 4/2007 | Bernardino et al. | |
| 2009/0145172 | A1 * | 6/2009 | Lubert | D06F 34/28 68/12.12 |
| 2010/0000022 | A1 | 1/2010 | Hendrickson et al. | |
| 2011/0145999 | A1 | 6/2011 | Motamedi | |
| 2012/0023679 | A1 * | 2/2012 | Hettinger | D06F 33/34 68/12.02 |
| 2012/0125373 | A1 * | 5/2012 | Grull | A47L 15/4217 134/94.1 |
| 2012/0311794 | A1 | 12/2012 | Hettinger et al. | |
| 2013/0232700 | A1 | 9/2013 | Smith et al. | |
| 2013/0235000 | A1 | 9/2013 | Lee et al. | |
| 2014/0259441 | A1 | 9/2014 | Fulmer et al. | |
| 2014/0259442 | A1 | 9/2014 | Fulmer et al. | |
| 2014/0259443 | A1 | 9/2014 | Fulmer et al. | |
| 2014/0259444 | A1 | 9/2014 | Fulmer et al. | |
| 2014/0259445 | A1 | 9/2014 | Fulmer et al. | |
| 2014/0259446 | A1 | 9/2014 | Ghosh et al. | |
| 2014/0259447 | A1 | 9/2014 | Alexander et al. | |
| 2014/0259448 | A1 | 9/2014 | Alexander et al. | |
| 2014/0259450 | A1 | 9/2014 | Alexander et al. | |
| 2014/0274868 | A1 | 9/2014 | Ghosh et al. | |
| 2014/0277751 | A1 | 9/2014 | Fulmer et al. | |
| 2015/0128358 | A1 | 5/2015 | Wells et al. | |
| 2015/0169194 | A1 | 6/2015 | Ban et al. | |
| 2015/0299929 | A1 | 10/2015 | Yang et al. | |
| 2016/0060800 | A1 * | 3/2016 | Ghosh | D06F 33/34 68/12.23 |
| 2017/0022649 | A1 * | 1/2017 | Roetker | D06F 35/006 |
| 2018/0282929 | A1 * | 10/2018 | Pollett | D06F 23/04 |

FOREIGN PATENT DOCUMENTS

| | | | |
|---|---|---|---|
| DE | 102008033793 | A1 | 1/2010 |
| DE | 102009046785 | A1 | 6/2010 |
| DE | 102010063995 | A1 | 6/2012 |
| EP | 1995751 | A2 | 11/2008 |
| EP | 1332204 | B1 | 12/2008 |
| EP | 2140795 | A1 | 1/2010 |
| EP | 2298978 | A2 | 3/2011 |
| EP | 2304756 | A1 | 4/2011 |
| EP | 2508667 | A1 | 10/2012 |
| EP | 2639676 | A2 | 9/2013 |
| EP | 2933369 | A1 | 10/2015 |
| IN | 01349DE2008 | | 12/2009 |
| KR | 100675796 | B1 | 2/2007 |
| WO | 0234873 | A1 | 5/2002 |
| WO | 2010007076 | A1 | 1/2010 |
| WO | 11066805 | A1 | 6/2011 |
| WO | 2012084627 | A1 | 6/2012 |
| WO | 15067965 | A1 | 5/2015 |
| WO | 2015101424 | A1 | 7/2015 |

OTHER PUBLICATIONS

Expert Reviews of the 8KG Front Load Electrolux Washing Machine EWF12832-APPLIANCES Online, https://www.youtube.com/watch?v=_AmPrXT2bGI, Accessed May 10, 2018.

LED Illuminated Doorbell Button, Bronze, Amber Illumination, https://www.houzz.com/product/17483071-led-illuminated-doorbell-button-bronze-amber-illumination-modern-doorbells-and-chimes, Accessed May 10, 2018.

European Search Report for Counterpart EP18179693.9, Dated Oct. 4, 2018.

* cited by examiner

FABRIC CLEANING APPLIANCE WITH PERFORMANCE ENHANCEMENT SELECTOR

CROSS-REFERENCE TO RELATED APPLICATION

This application is a divisional application of U.S. patent application Ser. No. 15/977,278, filed on May 11, 2018, now U.S. Pat. No. 10,988,881, issued Apr. 27, 2021, which claims priority to U.S. Provisional Patent Application No. 62/529,210, filed Jul. 6, 2017, both of which are incorporated herein by reference in their entirety.

BACKGROUND OF THE INVENTION

Fabric treating appliances such as washing machines typically operate to clean fabric by placing the fabric in contact with cleaning fluid such as soapy water, and providing relative motion between the clothes and/or the clothes and fluid. Commonly a fabric mover such as an agitator provides mechanical energy to a load of fabric immersed in the cleaning fluid by agitating the load in a manner that both jostles the fabric in the fluid and circulates the fluid through the fabric. A fabric treating appliance for home use can perform a select programmed series of operations on fabric placed in a basket or drum located within the interior of the appliance. The programmed operations can comprise a plurality of steps in a select sequence. One or more dispensers of treating chemistry, such as detergent, fabric softeners, or bleach can be activated manually or automatically at one or more designated points during a programmed cycle of operation.

SUMMARY

One aspect of the disclosure is a cycle of operation for a laundry treating appliance having a tub and a rotatable drum located within the tub and operably coupled with a motor for rotating the drum. The drum at least partially defines a treating chamber for receiving laundry for treatment according to a cycle of operation. The cycle of operation comprises a first wash phase formed of a cold wash liquid comprising a mixture of water and a first dose of treating chemistry, filling to a first level of water, and washing for a first amount of time. The wash cycle also has a second wash phase formed of a hot wash liquid comprising a mixture of water and a second dose of treating chemistry, filling to a water level lower than the first level of water, and washing for a second longer amount of time.

Another aspect of the disclosure is a method of operating a laundry treating appliance having a tub and a rotatable drum located within the tub and operably coupled with a motor for rotating the drum, the drum at least partially defining a treating chamber for receiving laundry for treatment according to a cycle of operation, and a treating chemistry dispenser comprising multiple treating chemistry cups configured to dispense treating chemistry to the treating chamber. The method comprises performing a first wash cycle comprising a cold wash liquid comprising a mixture of water and first dose of treating chemistry from one of the treating chemistry cups, filling to a first level of water, and washing for a first amount of time. Receiving at a controller a user selection of an activation of a performance enhancement selector. Upon activation of the performance enhancement selector, activating a second wash cycle comprising a mixture of water and a second dose of treating chemistry from another of treating chemistry cups, filling to a second water level, and washing for a second amount of time.

DESCRIPTION OF THE DRAWINGS

While this description will reference many different features for a fabric treating appliance, one very beneficial and advantageous feature is a user interface having a cycle selector that optionally provides enhanced operation for the selected cycle, especially an enhancement that increases or "boosts" the cleaning performance of the selected cycle. One aesthetically refined and functionally efficient implementation of the "boost" feature is the use of a combined rotatable knob and push button, which can be rotated to select the desired cycle and pushed to select the "boost" feature for the selected cycle.

Selection indicia for the cycle selection and the boost feature can be provided to indicate the selected cycle and optional "boost" feature. The selection indicia can be in the form of a pointer on the knob that is directed to the selected cycle as the knob is rotated, and a light source to illuminate all or part of the knob, such as a ring of light about the periphery of the knob, upon a pushing of the knob to indicate the "boost" option is selected. Additionally, "boost" indicia may be provided on the knob and illuminated up the selection of the "boost" option. The "boost" indicia can be the word "boost" or any of other suitable word or symbol to indicate that the enhanced performance is selected.

Aesthetically, the user interface with the single combination knob and pushbutton provides a very clean, simple and even elegant visual appearance. Functionally, the single combination knob and push button with selection indicia provides a very efficient and intuitive selector for both the cycle and the "boost" option.

Figure 1:
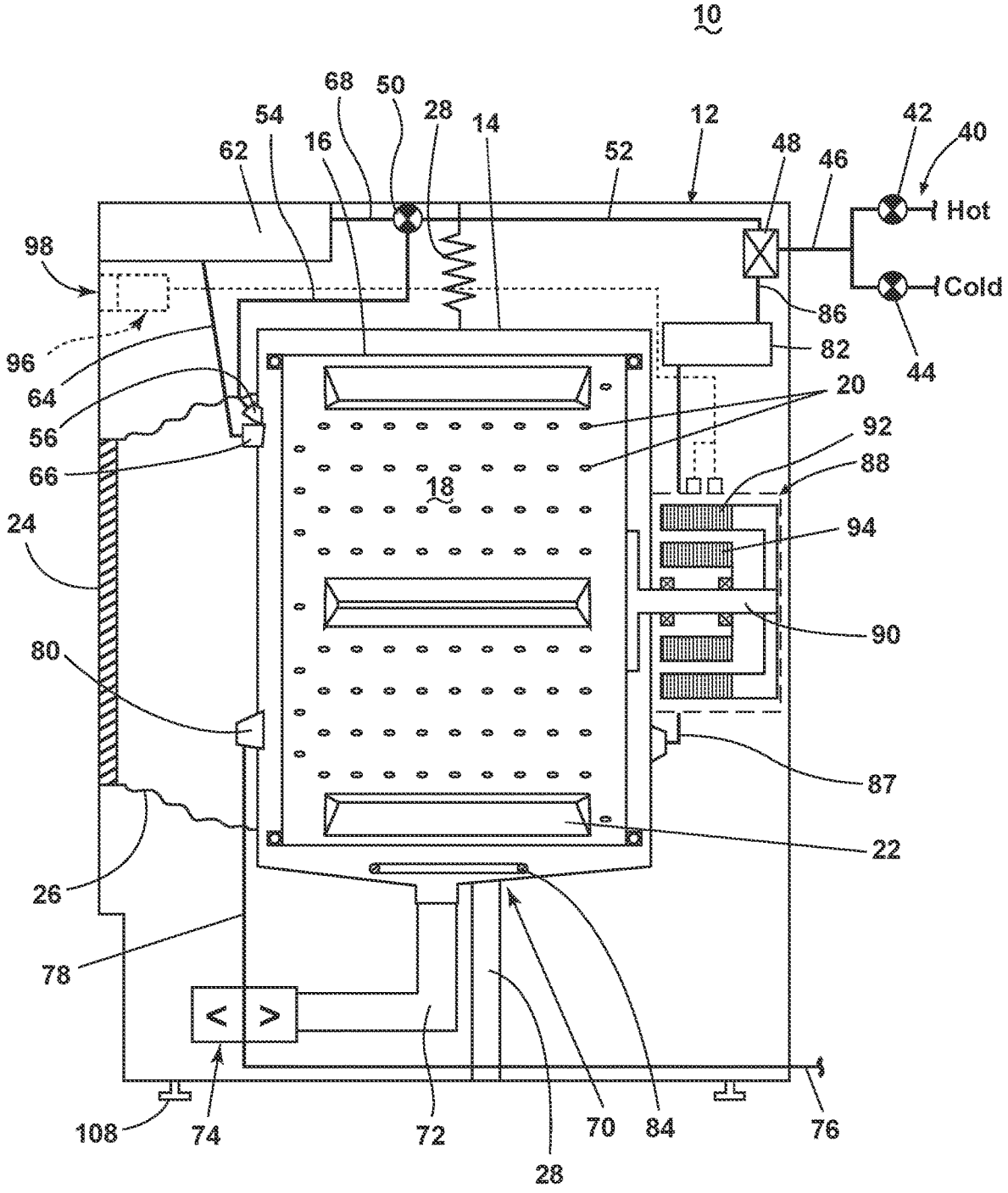
FIG. 1 is a schematic sectional view of a fabric treating appliance in the form of a horizontal axis washing machine.

FIG. 1 is a schematic view of a horizontal axis laundry treating appliance, such as a washing machine 10, which is just one possible environment for implementing the user interface with the combination cycle selector with optional "boost" selector. The user interface can be used in other environments than a fabric treating appliance. However, within the realm of fabric treating appliances, the fabric treating appliance can be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

Looking at the washing machine 10 in greater detail, illustrated as a washing machine, which can include a structural support system comprising a cabinet 12 defining a housing within which a fabric holding system resides. The cabinet 12 can be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention The fabric holding system comprises a tub 14 supported within the cabinet 12 by a suitable suspension system and a drum 16 provided within the tub 14, the drum 16 defining at least a portion of a fabric treating chamber 18. The drum 16 can include a plurality of perforations 20 such that liquid can flow between the tub 14 and the drum 16 through the perforations 20. A plurality of baffles 22 can be disposed on an inner surface of the drum 16 to lift the fabric load received in the treating chamber 18 while the drum 16 rotates. It is also within the scope of the invention for the fabric holding system to comprise only a tub with the tub defining the fabric treating chamber.

The fabric holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14.

The washing machine 10 can further include a suspension system 28 for dynamically suspending the fabric holding system within the structural support system.

The washing machine 10 can further include a liquid supply system for supplying water to the washing machine 10 for use in treating fabric during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14.

The washing machine 10 can also be provided with a dispensing system for dispensing treating chemistry to the treating chamber 18 for use in treating the fabric according to a cycle of operation. The dispensing system can include a dispenser 62 which can be a single use dispenser, a single use dispenser with multiple compartments, a bulk dispenser or a combination of a single use and bulk dispenser. The multiple compartments traditionally include predetermined compartments for detergent, fabric softener, bleach, and other treating chemistries as desired. Non-limiting examples of suitable dispensers are disclosed in U.S. Pat. No. 8,196,441 to Hendrickson et al., filed Jul. 1, 2008, entitled "Household Cleaning Appliance with a Dispensing System Operable Between a Single Use Dispensing System and a Bulk Dispensing System," U.S. Pat. No. 8,388,695 to Hendrickson et al., filed Jul. 1, 2008, entitled "Apparatus and Method for Controlling Laundering Cycle by Sensing Wash Aid Concentration," U.S. Pat. No. 8,397,328 to Hendrickson et al., filed Jul. 1, 2008, entitled "Apparatus and Method for Controlling Concentration of Wash Aid in Wash Liquid," U.S. Pat. No. 8,813,526 to Doyle et al., filed Jul. 1, 2008, entitled "Water Flow Paths in a Household Cleaning Appliance with Single Use and Bulk Dispensing," U.S. Pat. No. 8,397,544 to Hendrickson, filed Jun. 23, 2009, entitled "Household Cleaning Appliance with a Single Water Flow Path for Both Non-Bulk and Bulk Dispensing," and U.S. Pat. No. 8,438,881, filed Apr. 25, 2011, entitled "Method and Apparatus for Dispensing Treating Chemistry in a Fabric Treating Appliance," which are herein incorporated by reference in full.

Regardless of the type of dispenser used, the dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the dispenser 62 from the supply conduit 52 by directing the diverter mechanism 50 to direct the flow of water to a dispensing supply conduit 68.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the fabric holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the fabric within.

The liquid supply and/or recirculation and drain system can be provided with a heating system which can include one or more devices for heating fabric and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the fabric and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 88, which can be directly coupled with the drum 16 through a drive shaft 90 to rotate the tub 14 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The washing machine 10 also includes a control system for controlling the operation of the washing machine 10 to implement one or more cycles of operation. The control system can include a controller 96 located within the cabinet 12 and a user interface 98 that is operably coupled with the controller 96. The user interface 98 can include one or more rotary knobs, push buttons, dials, switches, displays, touch screens and the like for communicating with the user, such as to receive input and provide output. The user can enter different types of information including, without limitation, cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
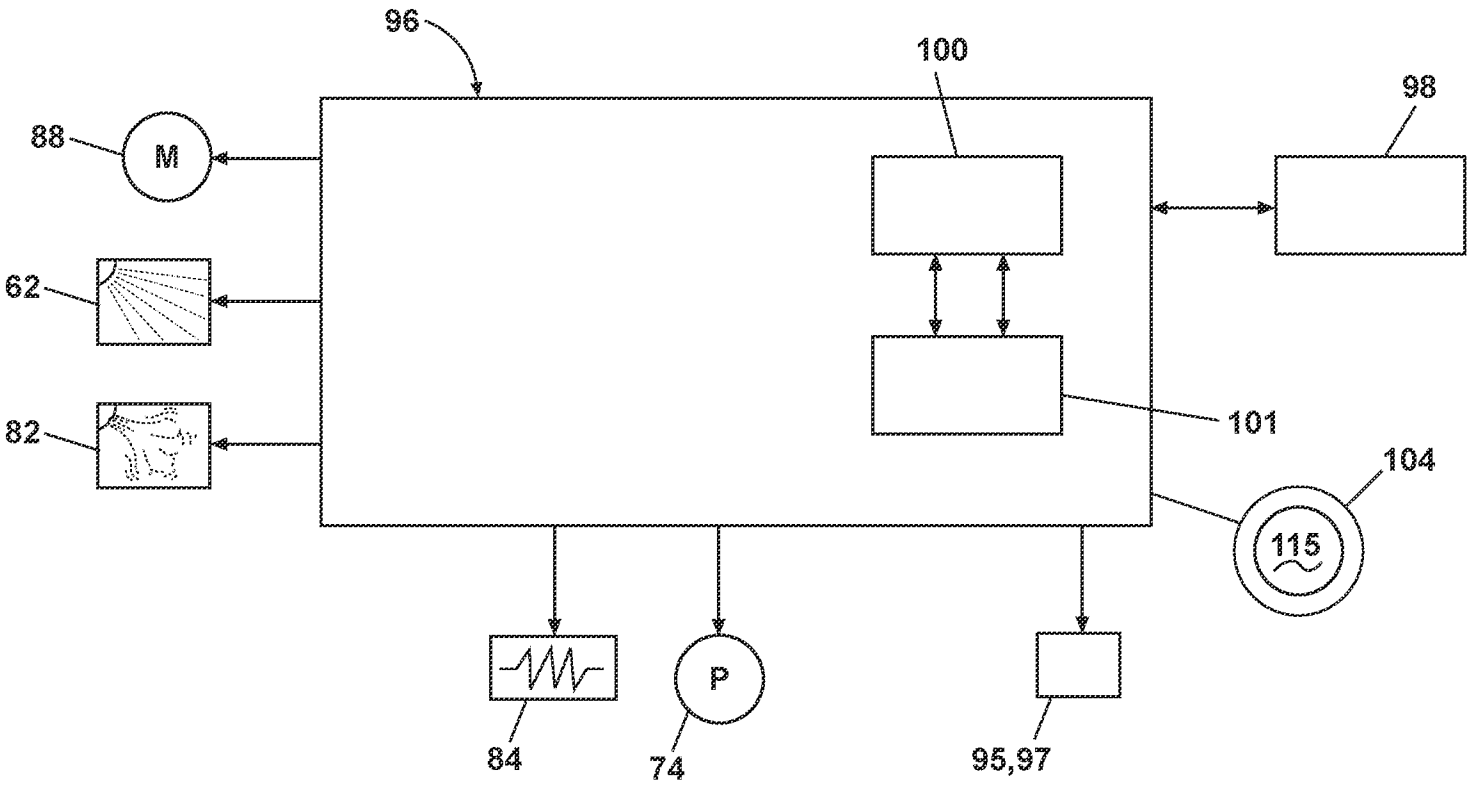
FIG. 2 is a schematic view of a controller of the washing machine of FIG. 1.

FIG. 2 illustrates an exemplary controller 96 coupled with a user interface 98 having a cycle selector 104 with a performance enhancer selector 115. The controller 96 is provided with a memory 100 and a central processing unit (CPU) 101. The memory 100 can be used for storing the control software that is executed by the CPU 101 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 can be used to store wash parameters associated with individual or multiple wash cycles. The memory 100 can also be used to store information, such as a database or table, and store data received from one or more components (i.e. sensors) of the washing machine 10 that can be communicably coupled with the controller 96. The database or table can be used to store the various operating parameters for the one or more cycles of operation, including factory default values for the operating parameters for any adjustments made to the cycle selection by the control system or by user input.

The controller 96 can be operably coupled with one or more components of the washing machine 10 for communicating with and controlling the operation of the component to complete a cycle of operation. For example, the controller 96 can be operably coupled with the motor 88, the pump 74, the dispenser 62, the steam generator 82 and the sump heater 84 to control the operation of these and other components to implement one or more of the cycles of operation.

The controller 96 can also be coupled with one or more sensors 95 provided in one or more of the systems of the washing machine 10 to receive input from the sensors 95, which are known in the art and not shown for simplicity. Non-limiting examples of sensors 95 that can be communicably coupled with the controller 96 include: a treating chamber temperature sensor, turbidity sensor, fluorescent sensor, surface tension sensor, conductivity sensor, moisture sensor, weight sensor, chemical sensor, a position sensor and a motor torque sensor, which can be used to determine a variety of system and fabric characteristics, such as fabric load inertia or mass.

In one example, one or more load amount sensors 97 can also be included in the washing machine 10 and can be positioned in any suitable location for detecting the amount of fabric, either quantitative (inertia, mass, weight, etc.) or qualitative (small, medium, large, etc.) within the treating chamber 18. By way of non-limiting example, it is contemplated that the amount of fabric in the treating chamber can be determined based on the weight of the fabric and/or the volume of fabric in the treating chamber. Thus, the one or more load amount sensors 97 can output a signal indicative of either the weight of the fabric load in the treating chamber 18 or the volume of the fabric load in the treating chamber 18.

The one or more load amount sensors 97 can be any suitable type of sensor capable of measuring the weight or volume of fabric in the treating chamber 18. Non-limiting examples of load amount sensors 97 for measuring the weight of the fabric can include load volume, pressure, or force transducers which can include, for example, load cells and strain gauges. It has been contemplated that the one or more such load amount sensors 97 can be operably coupled to the suspension system 28 to sense the weight borne by the suspension system 28. The weight borne by the suspension system 28 correlates to the weight of the fabric loaded into the treating chamber 18 such that the load amount sensor 97 can indicate the weight of the fabric loaded in the treating chamber 18. In the case of a suitable load amount sensor 97 for determining volume it is contemplated that an IR or optical based sensor can be used to determine the volume of fabric located in the treating chamber 18.

Alternatively, it is contemplated that the washing machine 10 can have one or more pairs of feet 108 extending from the cabinet 12 and supporting the cabinet 12 on the floor and that a weight sensor (not shown) can be operably coupled to at least one of the feet 108 to sense the weight borne by that foot 108, which correlates to the weight of the fabric loaded into the treating chamber 18. In another example, the amount of fabric within the treating chamber 18 can be determined based on motor sensor output, such as output from a motor torque sensor. The motor torque is a function of the inertia of the rotating drum and fabric. There are many known methods for determining the load inertia, and thus the load mass, based on the motor torque. It will be understood that any suitable method and sensors can be used to determine the amount of fabric.

The previously described washing machine 10 provides one possible environment for the implementation of cycle selector 104 with the combined performance enhancer selector 115, along with other aspects of this disclosure including the control of the number of washes, the speed of the motor 88, the movement of the fabric within the fabric treating chamber 18, the quantity and number of a dose or doses of treating chemicals, the temperature of the water, and the desired mechanical cleaning action.

Figure 3A:
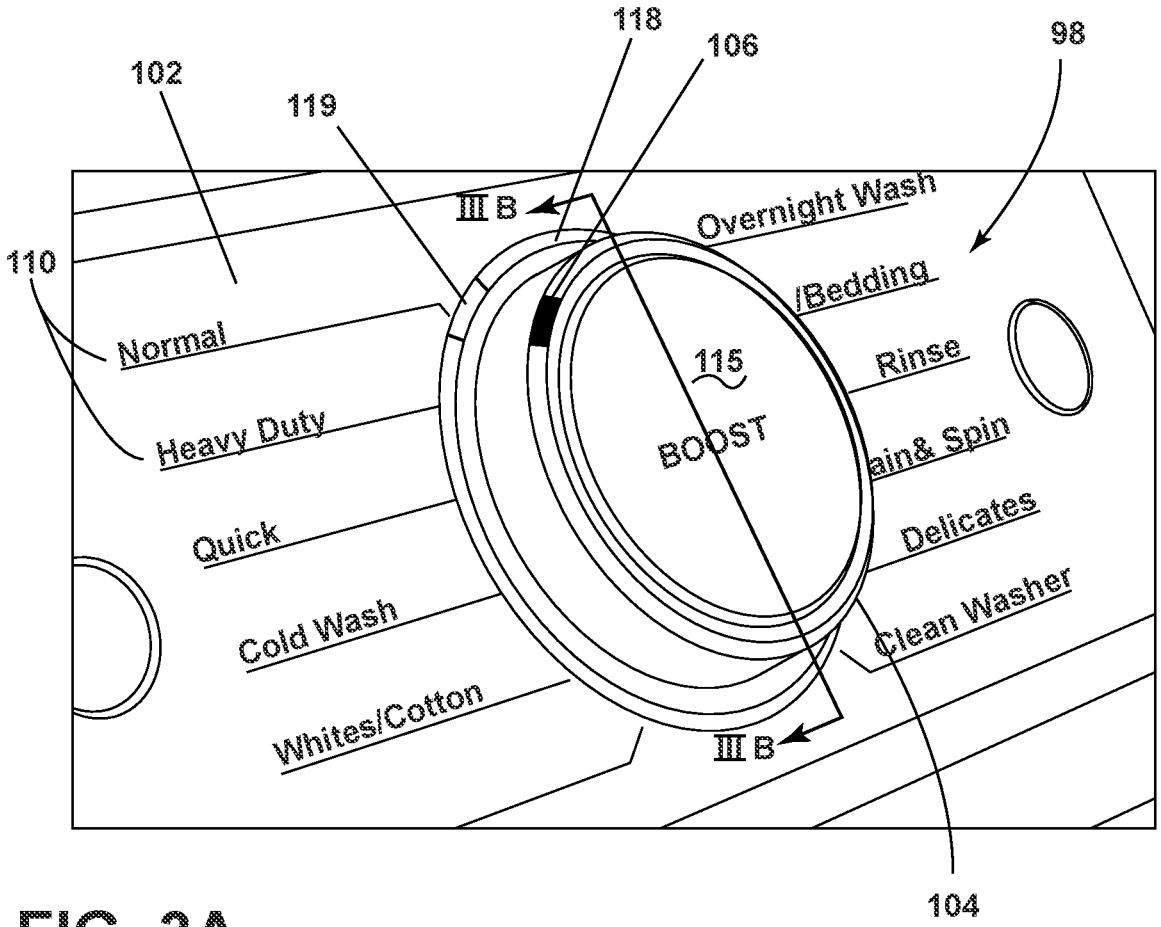
FIG. 3A is a perspective view of the user interface of FIG. 2 illustrating an input selector performing as both a cycle selector and a performance enhancement selector.

A close up of the user interface 98 having the cycle selector 104 with the performance enhancer selector 115 is shown in FIG. 3A. The user interface 98 has a front panel 102 that can have a plurality of user inputs/outputs such as one or more rotary knobs, push buttons, dials, switches, displays, touch screens and the like through which the user and the appliance can communicate. One of the inputs is the cycle selector 104 with performance enhancer selector 115. Other cycle selection modifiers (not shown) which the user can choose from such as variations to cycle parameters such as water level, hot or cold water options, etc.

The cycle selector 104 can have an indicator in the form of a pointer 106, which can, but does not have to be illuminated, and is configured to be rotated until the pointer 106 points to one of a plurality of cycle indicia corresponding to a specific wash cycle 110, distributed around the periphery of the cycle selector 104 on the front panel 102.

While the cycle indicia could list any type of wash cycle or wash parameter, the list of specific wash cycles 110 distributed around the periphery of the cycle selector 104 can be based on parameters or characteristics of a wash load or traditional standard wash cycles such as Normal, Heavy Duty, Quick, Cold Wash, Whites, Cotton, Delicates, Rinse, Drain, etc. As should be recognized, the specific wash cycle 110 and the functionality performed by the washing machine 10 based on a selection of a specific wash cycle 110 can be based on other characteristics such as clothes soil level, water level, load size or any combinations of characteristics thereof.

In a non-limiting example, the front panel 102 can carry an annular ring 118 surrounding the cycle selector 104 that is configured to illuminate in response to cycle selector 104 rotation. When the pointer 106 on the cycle selector 104 is rotated to align with a specific wash cycle 110, the annular ring 118 can illuminate a ring portion 119 corresponding to the selected specific wash cycle 110. The annular ring 118 could be any type of known material, such as plastic, that can be illuminated by LED or other known lighting source.

The user interface 98 can also comprise a performance enhancer selector 115 in the form of a push-button. The cycle selector 104 and performance enhancement selector 115 are relatively configured such that the pushing of the performance enhancement selector 115 selects an optional adjustment for the selected cycle. In the illustrated example, the performance enhancement selector 115 is a push button located interiorly of the cycle selector 104, which can freely rotate around a push button.

In this exemplary embodiment, the cycle selector 104 circumferentially surrounds and carries the performance enhancement selector 115, but the performance enhancement selector 115 does not rotate with the cycle selector 104. The performance enhancement selector 115 can be centrally located in the cycle selector 104 in communication with the controller 96. The combining of the cycle selector 104 with the performance enhancement selector 115 is visually pleasing in a clean and simple way while being efficient in that the user can select the cycle and the optional adjustment with the same user input.

Cycle adjustment selector indicia in the form of an illuminated ring 121 and illuminated words such as "Boost" can be provided within the performance enhancement selector 115. When the performance enhancement selector 115 is actuated, the ring 121 and/or the word "Boost" are illuminated to indicate to the user that the performance enhancement selector 115 is actuated. Also, shapes other than a ring and words other than "Boost" can be used. A benefit of using both indicia, including a symbol and the word, is that it provides the user with robust feedback that correlates with the robust cleaning performance that will be provided by selection of the performance enhancement selector 115.

Figure 3B:
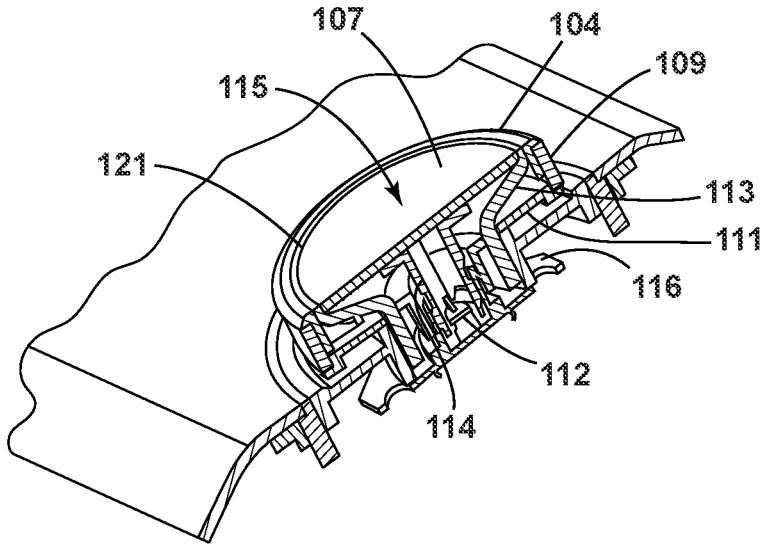
FIG. 3B is a cross-sectional view of the input selector of FIG. 3B taken across line III B-III B in FIG. 3A.

The internal details of the cycle selector 104 and performance enhancement selector 115 are seen with respect to FIG. 3B, which is a cross-sectional view of the performance enhancement selector 115 taken across line B-B in FIG. 3A. The cabinet front panel 102 carries the cycle selector 104. The cycle selector 104 is generally a rotating knob having a backplate 111 and a cylindrical collar 109. The backplate 111 and the cylindrical collar 109 could be separate parts where the backplate 111 carries the cylindrical collar 109, which can be rotated about front panel 102 or formed together as a single part that is configured to rotate about front panel 102. The performance enhancement selector 115 can be a selectively depressable button generally defined by housing 113 within the cylindrical collar 109 and moveable relative thereto. The performance enhancement selector 115 can have a face plate 107 being supported by support member 114 and carried by resistance or spring support structure 116. The spring support structure 116 is configured to move the face plate 107 or the performance enhancement selector 115 to its original at rest position after being depressed.

While not required, certain portions of the cycle selector 104 and performance enhancement selector 115 can be configured to light up in response to user selection or activation. The front panel 102 may carry one or more LED's (not shown) generally behind the button and positioned to backlight the button or other areas on the user interface. Performance enhancement selector 115 can have light guide 112 positioned to allow light to light up housing 113 including inner annular ring 121 surrounding the face plate 107 in response to face plate 107 being depressed. In addition, any wording in the center of the performance enhancement selector 115, such as, but not limited, to "Boost" as shown in FIG. 3A, would also light up in response to the performance enhancement selector 115 being depressed. The annular ring 121 and/or wording could be any type of known material, such as plastic, that can be illuminated by LED or other lighting source.

It should be noted that performance enhancement selector 115 is not limited to the form of a push-button. It can alternatively be a knob, wheel, touch screen, other known mechanical or electrical selector/interface. In addition, while the above describes an exemplary embodiment of the performance enhancement selector 115, it could be located virtually any place on the user interface 98.

Figure 3C:
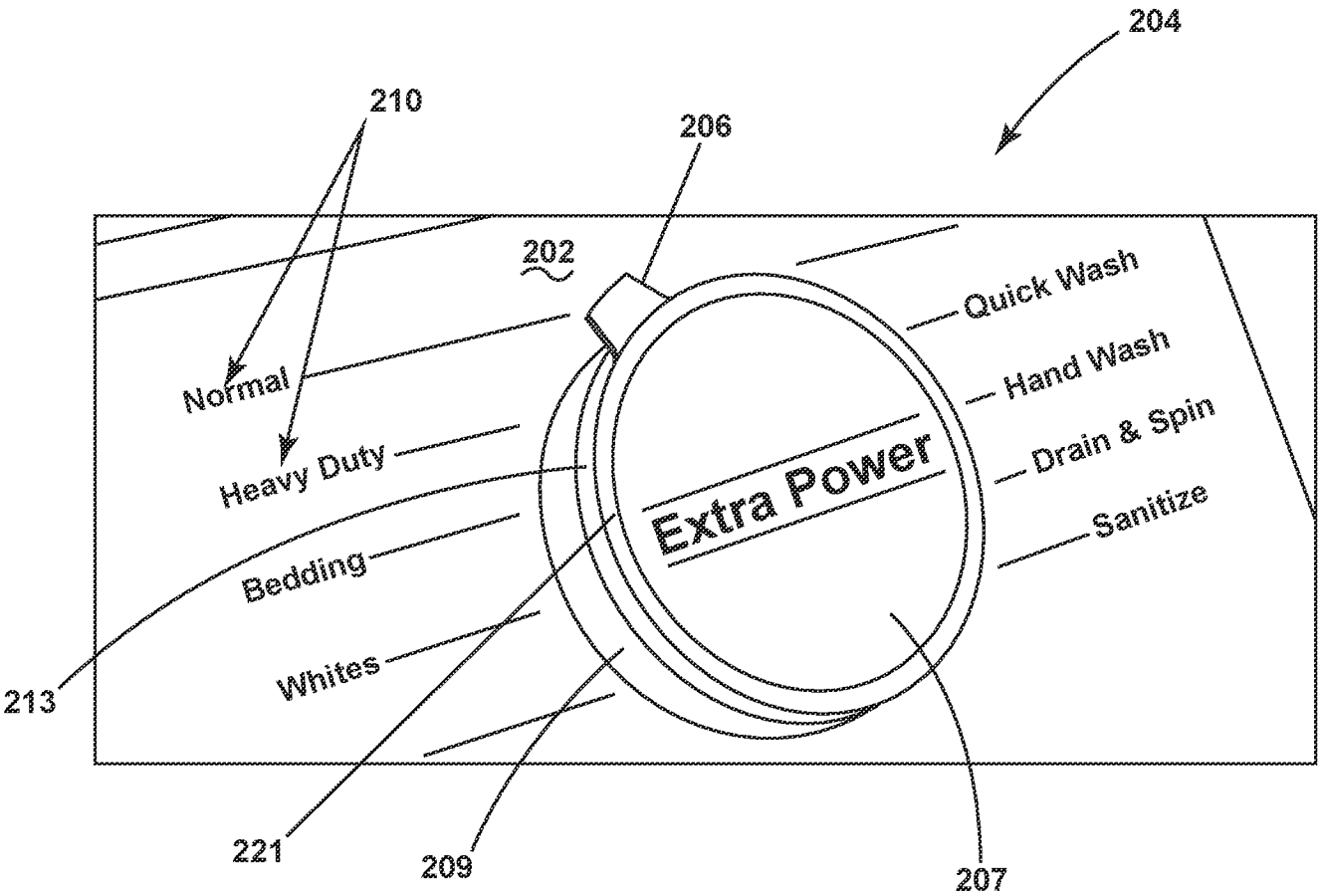
FIG. 3C is an alternate embodiment of a user interface of FIG. 2 illustrating an input selector performing as both a cycle selector and a performance enhancement selector.

An alternative cycle selector 204 and performance enhancement selector 215 is illustrated in FIG. 3C. Since the cycle selector 204 is similar to the cycle selector 104; like parts will be identified with like numerals increased by 100. The cycle selector 204 can have an indicator in the form of a pointer 206 that is configured to be rotated until the pointer 206 points to one of a plurality of cycle indicia corresponding to a specific wash cycle 210, distributed around the periphery of the cycle selector 204 on the front panel 202. As illustrated, the front panel 202 carries the cycle selector 204. The cycle selector 204 is generally a rotating knob having a cylindrical collar 209 and a depressable face plate 207. The cylindrical collar 209 can be rotated about front panel 202. The face plate 207 defines the depressable portion of the performance enhancement selector 215 in the form of a selectively depressable button.

Similar to the exemplary cycle selector 104 and performance enhancement selector 115 in FIGS. 3A and 3B, the cycle selector 204 and performance enhancement selector 215 can also be configured to light up in response to user selection or activation. Performance enhancement selector 215 can light to light up inner annular ring 221 surrounding the face plate 207 in response to face plate 207 being depressed. In addition, any wording in the center of the performance enhancement selector 215, such as, but not limited, to "EXTRA POWER" as shown in FIG. 3C, can also light up in response to the performance enhancement selector 215 being depressed. The annular ring 221 and/or wording could be any type of known material, such as plastic, that can be illuminated by LED or other lighting source.

Figure 4:
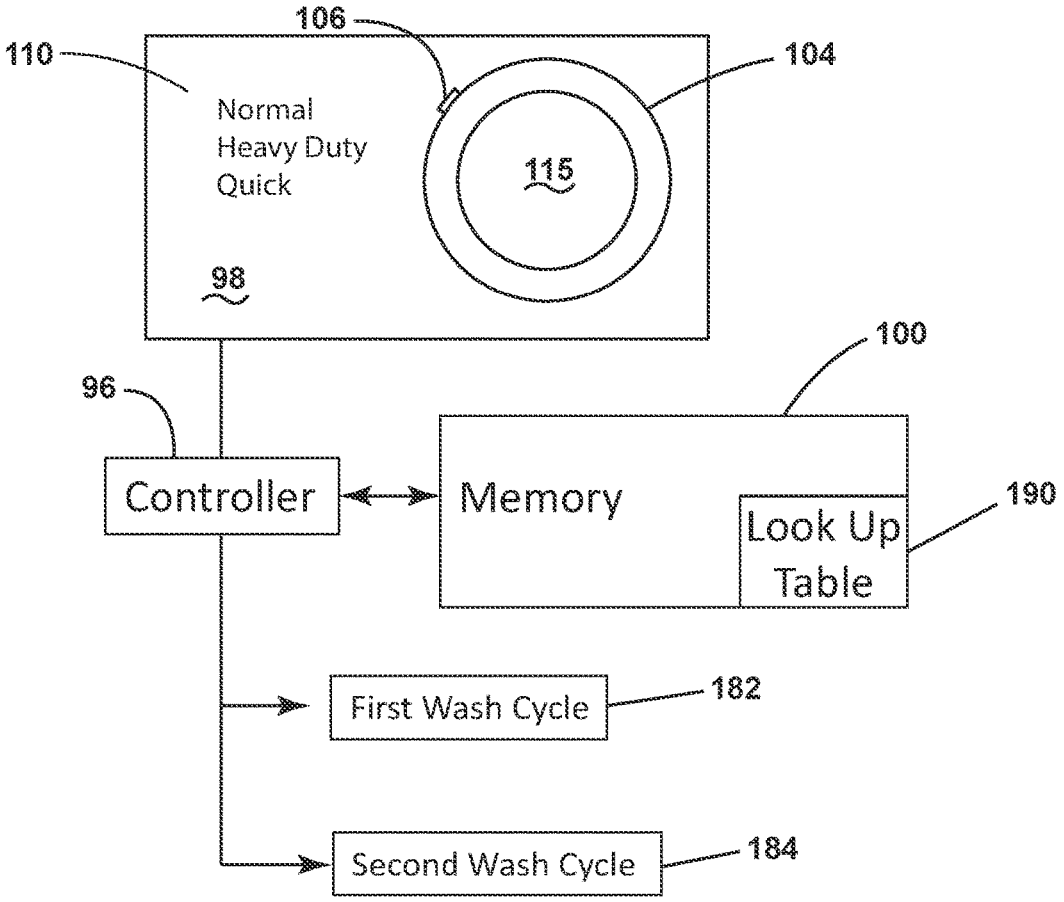
FIG. 4 is a block diagram of the user interface and associated wash cycle parameter adjustment activated by the performance enhancement selector.

FIG. 4 depicts one enhancing or boosting feature that can result from activating the performance enhancement selector 115; that is, performing a multiple wash cycle. In a multiple wash cycle environment, a first wash 182 can be performed where fabric is washed in accordance with the cycle selected for some amount of time. This first wash cycle 182 can be terminated after chemical equilibrium is reached and only mechanical cleaning is occurring, which can be determined by directly or indirectly monitoring the surfactant in the wash liquid by a suitable sensor. At the end of the first wash cycle 182, a second wash cycle 184 can be initiated. At the start of the second wash cycle 184 a second dose of detergent can be added, with or without the wash liquid being drained. A sensor 95, such as a turbidity sensor, can sense the turbidity of the wash liquid and the machine can be programmed to make a determination whether to drain the wash liquid from the first wash cycle 182 based on the sensor reading. In this example, the washing machine 10 can be programmed to implement the multiple washes in a single cycle and can be programmed to interpret turbidity or other sensor readings. A look up table 190 can be stored in the memory 100 with predefined characteristics of each of the two wash cycles 182, 184 for any given wash cycle 110 as well as actions to be performed based on sensor readings.

In one exemplary embodiment, in a horizontal axis washing machine, activating the performance enhancement selector 115 may result in the activation of multiple wash steps, each with a different water fill level or water temperature so that different types of clothes or different types of stains or soils will get exposed to a fill level or a water temperature that works best for that type of clothing, stains and/or soils. For example, some stains remove easily in cold water, but set in hot water. So, a first wash cycle 180 may be run to aid in removing the stain, and the second wash cycle 182 may be run in hot water for the benefit of washing the other clothing in the wash load. In more detail, the first cycle 180 can be programmed to be relatively short in duration (5 to 15 minutes), in cold water (e.g. less than 95 degrees F.), and with detergent dose from the dispenser 62. The second wash cycle 182 can be longer than the first (10 minutes to 2 hours or more), in hot water (e.g. above 95 degrees F.) and with a dose of detergent from the same or different dispenser 62. In the example above, the first wash step can have detergent concentration of 3 to 4 grams of detergent per liter of water, and the second wash step can have detergent added back in in an attempt to reach a similar concentration. Alternatively, the wash cycles could have different water fill levels to allow for different detergent concentrations in each wash. For example, the first wash could be either a higher or lower fill level wash, followed by a second higher or lower fill level wash, with each wash having various combinations of water temperatures and detergent concentrations. The dosing or dispensing of detergent can occur between wash cycles 180, 182 or a second dose could be added to a first wash cycle if a higher concentration of detergent is desired. As described in further detail below, a second dose of detergent can come from a bulk dispenser or a dedicated detergent cup. It should be recognized that the above wash steps could be performed in a vertical axis machine as well.

A benefit of performing this type of double wash is that washing in multiple wash temperatures enhances and boosts cleaning performance. This is particularly useful in horizontal axis washers which use very little water, so the only option for changing temperature of the wash liquid fill is to use the heater. In a multiple wash cleaning cycle, a first wash in a cool or warm temperature may wash out certain stains that may get set in at higher temperatures. A subsequent second wash in hot water potentially boosts cleaning of all soils and stains that benefit from hotter temperatures. If further washes are used, a similar pattern could be followed.

Figure 5:
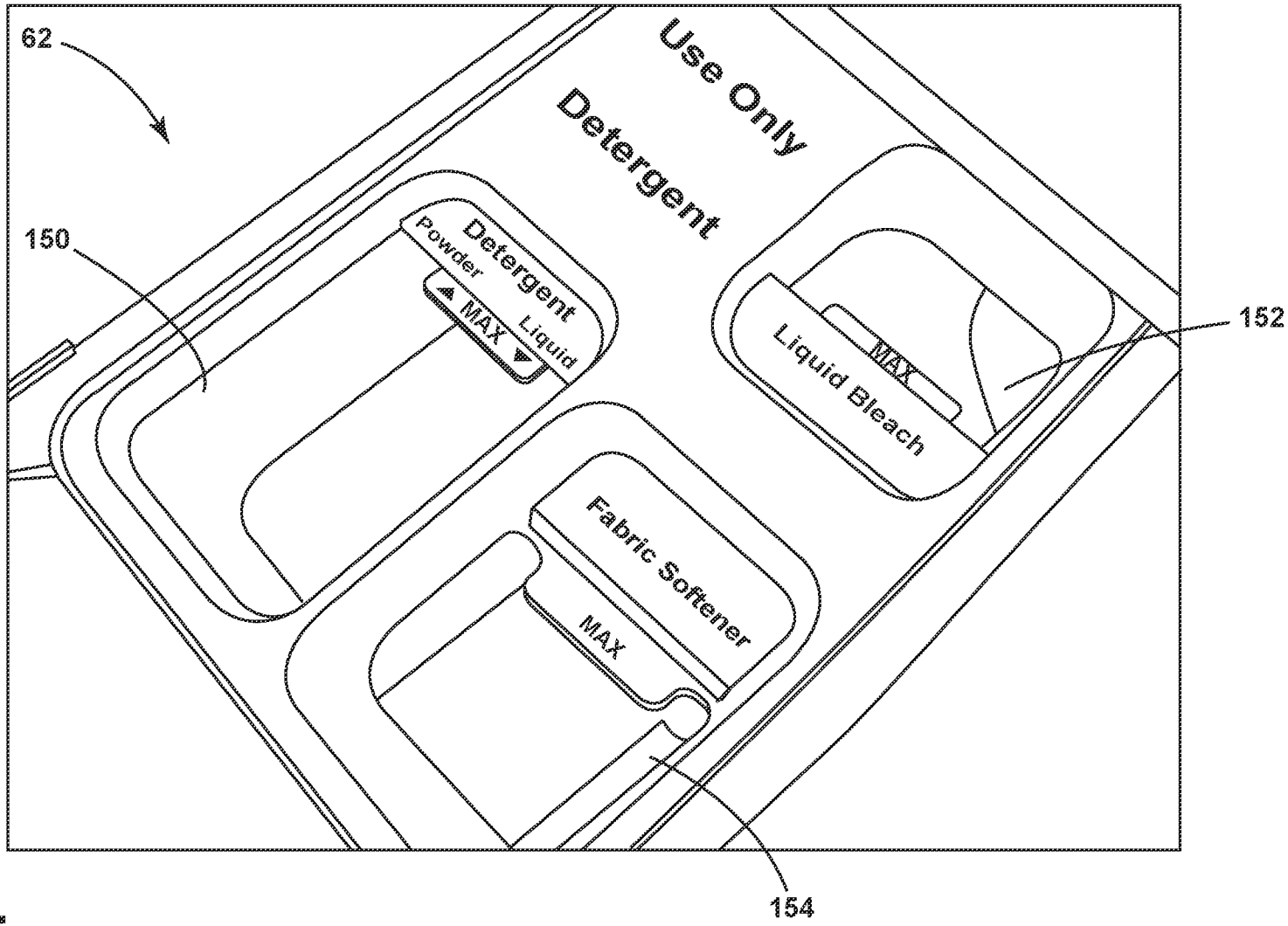
FIG. 5 is a perspective view of a multi-compartment dispenser as used in a multiple wash cycle.

If the washing machine 10 is going to perform multiple washes or dose multiple doses of detergent in a cycle, the machine 10 can be configured to dispense multiple doses of detergent. One solution is illustrated in FIG. 5, which shows an exemplary standard dispenser 62 used in many washing machines sold today. Use of a standard dispenser is an inexpensive option as only software would need to be changed to implement a double wash or double dose cycle. The washing machine 10 can be programmed to dispense the contents of each compartment in predetermined order and if the performance enhancement selector 115 is activated, the various compartments in the dispenser can be programmed for different patterns and different times of use in the wash cycle.

The standard dispenser 62 can have multiple compartments/dispensers 150, 152, 154 within the dispenser 62: a detergent dispenser 150, a bleach dispenser 152, and a fabric softener dispenser 154. It is contemplated that the bleach dispenser 152 can act as a second detergent cup for the second wash 184 upon activation of the performance enhancement selector 115 when performing a multiple wash or multiple detergent dose cycle. When a user selects the performance enhancement selector 115, the controller 96 will dispenser chemistry from the bleach dispenser 152, in which, the user, in anticipation of selecting the performance enhancement selector 115, may load a chemistry other than bleach. The use of the bleach dispenser 152 for the second charge of chemistry avoids the need for a special dispenser 62 having a dedicated dispenser compartment for the performance enhancement selector 115, although it is contemplated that such a dedicated dispenser compartment can be provided. Other alternatives to providing detergent for a multiple wash or multiple dose cycle includes use of a bulk dispenser having the capacity to dispense multiple dispensing doses or the washing machine 10 can be programmed to prompt the user to add more detergent before the cycle start or even stop between cycles and prompt the user to add more detergent at that time. In addition it is contemplated that a separate user input can be added to the user interface 98 on the front panel, giving the user an option to select a multiple wash or double dose dispensing option.

Figure 6:
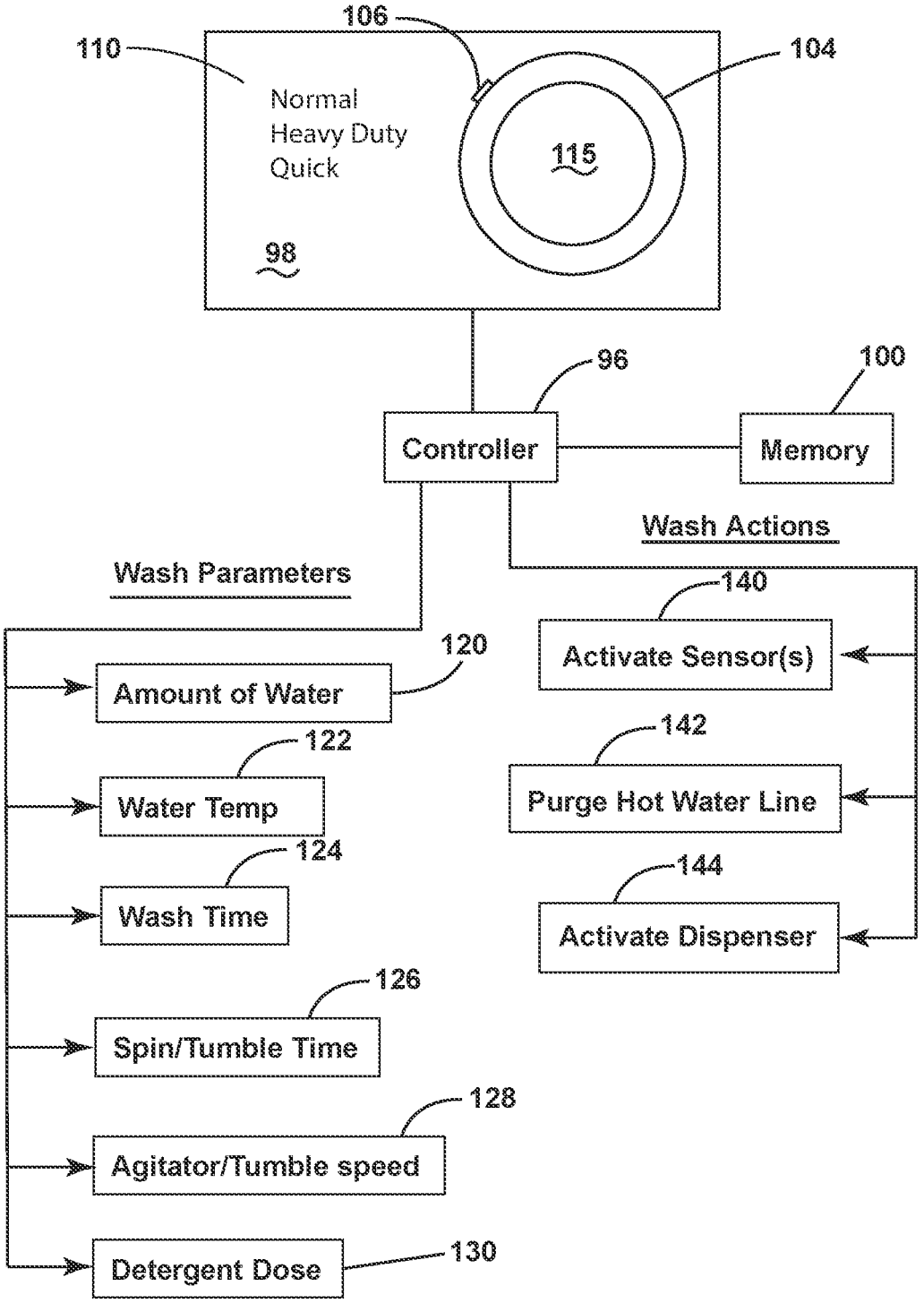
FIG. 6 is an exemplary block diagram of a user interface and associated with a multiple wash cycle activated by the performance enhancement selector.

It is contemplated that activation of the performance enhancement selector 115 can perform other wash actions/changes in addition to or in lieu of a multiple wash or multiple dose wash. FIG. 6 illustrates some additional examples. For example, the washing machine 10 can add, subtract, or modify one or more parameters of the specific wash cycle 110, such as the amount of water 120, water temperature 122, wash time 124, spin/tumble time 126, agitator/tumble speed 128, detergent dosing or concentration 130, and the like or any combination thereof. Changes to one or more of these wash parameters, or the addition or subtraction of wash parameters or wash cycles can alter the cleaning ability or provide additional or enhanced cleaning performance to any given wash cycle. It should also be noted that adjustments to the specific wash cycle 110 due to activation of the performance enhancement selector 115 can occur pre-wash or mid-wash, or can be programmed to automatically occur. Accordingly, selection of the performance enhancement selector 115 can improve cleaning performance.

The performance enhancement selector 115 can also boost or enhance functionality by changing the detergent dosing amount or concentration 130 by adding additional detergent to improve cleaning performance at any point during a wash cycle. Changing the detergent dosing amount or concentration 130 can be done in various ways, but typically is achieved by dispensing additional detergent from a dispenser 62 within the washing machine 10. In other words, a washing machine 10 can include one or more dispensers, a dispenser with multiple compartments or a bulk dispenser that activates upon selection or activation of the performance enhancement selector 115. Upon activation of the performance enhancement selector 115, the dispenser 62 can be programmed to activate based on programmed number of wash cycles, programmed cycle parameters, user selections, sensor readings, or any combination thereof.

In a non-limiting example, a washing machine 10 carrying a dispenser such as a bulk dispenser 62 can be configured to hold a treating chemistry or be partitioned to hold two or more treating chemistries. Treating chemistries, such as a detergent, fabric softeners, bleach, etc. could be stored in one or more bulk dispensers or detergent housings The memory 100 in the washing machine 10 could be programmed to dispense differing doses of treating chemistries from any of the various dispenser housings or partitions of a dispenser with multiple compartments or bulk dispenser and at various times throughout the one or more wash cycles.

The washing machine 10 may also take other actions based on activation of the performance enhancement selector 115 which boosts or enhances functionality to help improve cleaning performance. For example, the activation of performance enhancement selector 115 can activate one or more sensors 140 or can purge a hot water line 142. These activations can also result in real-time actions or measurements that can be used to implement adjustments to the parameters of a specific wash cycle 110.

In a non-limiting example, the washing machine 10 can be programmed to take the action to purge a hot water line 142 for a specific period of time or until a temperature sensor 105 senses a water temperature above a specified level. The action of purging the hot water line 142 can be programmed to be performed before every cycle, can be programmed to be performed upon a user's activation of the performance enhancement selector 115, or can be programmed to occur based on some combination of the following criteria: time elapsed since running the last wash cycle, water temperature of measured hot water, use of multiple washes, use of a bulk dispenser, or any combination thereof. For example, purging the hot water line 142 can be programmed to occur between multiple wash steps to allow for each wash step to be completed at different temperatures. The action of purging a hot water line 142 can be executed in several ways, including continuously filling hot water to sump 70 and draining the sump 70 until a target temperature measured in the sump 70 is reached. Or, if multiple wash steps are performed, then the washing machine 10 can be programmed to purge the hot water line 142 between each wash, or can be programmed to purge the hot water line 142 for the first wash fill step, and for the second wash fill step switch to an automatic temperature control routine.

Upon activation of the performance enhancement selector 115, the washing machine 10 can be programmed to take the action to activate sensors 140 in the washing machine 10. Sensors 95 can be activated pre-cycle or mid-cycle to measure a characteristic about a wash cycle and make a determination whether to change or adjust a wash parameter of the specific wash cycle 110. In a non-limiting example, a sensor 95 such as a turbidity, fluorescence, surface tension or continuity can be used to either alter a target treating chemistry dose prewash or can be used to make a mid-cycle determination of whether additional treating chemistry should be added. Look up tables can be stored in memory 100 that determine actions to be taken based on various sensor readings.

In addition, detergent dosing could be based on sensor readings relating to inertia measurement of the load when dry at the start of a cycle, cycle selection, water hardness, suds history, soil level setting or other preprogrammed or user selected parameters. If a user were to select a specific wash cycle 110 along with activating the performance enhancement selector 115, the washing machine 10, can be programmed to add or lower the water level before the cycle begins, and/or can be programmed to activate a sensor 95, such as a continuity sensor, mid-cycle to sense detergent concentration. The user interface 98 could also be programmed with logic to decide whether or not to add more detergent based on the sensor readings. Look up tables can be stored in memory 100 that determine actions to be taken based on sensor readings relating to chemistry concentrations. Although the invention has been described and illustrated in exemplary forms with a certain degree of particularity, it is noted that the description and illustrations have been made by way of example only. Numerous changes in the details of construction, combination, and arrangement of parts and steps can be made without deviating from the scope of the invention. Accordingly, such changes are understood to be inherent in the disclosure. The invention is not limited except by the appended claims and the elements explicitly recited therein.

What is claimed is:

1. A cycle of operation for a laundry treating appliance having a tub and a rotatable drum located within the tub and operably coupled with a motor for rotating the drum, the drum at least partially defining a treating chamber for receiving laundry for treatment according to a cycle of operation, the cycle of operation comprising:

a first wash phase comprising forming a cold wash liquid comprising a mixture of water and a first dose of treating chemistry, filling to a first level of water, and washing for a first amount of time;

an activation of a performance enhancement selector; and a second wash phase comprising forming a hot wash liquid comprising a mixture of water and a second dose of treating chemistry, filling to a second level of water, and washing for a second longer amount of time.

2. The cycle of operation of claim 1 wherein the first dose of treating chemistry comprises a detergent.

3. The cycle of operation of claim 2 wherein the second dose of treating chemistry comprises a detergent.

4. The cycle of operation of claim 3 wherein a concentration of the detergent in the second wash phase is different than a concentration of the detergent in the first wash phase.

5. The cycle of operation of claim 1 wherein the first wash phase is stopped after a fixed amount of time.

6. The cycle of operation of claim 1 wherein the cold wash liquid is drained before the second wash phase begins.

7. The cycle of operation of claim 6 wherein the first dose of treating chemistry in the first wash phase is dispensed from a first dedicated detergent cup.

8. The cycle of operation of claim 7 wherein the second dose of treating chemistry in the second wash phase is dispensed from a second dedicated detergent cup.

9. A method of operating a laundry treating appliance having a tub and a rotatable drum located within the tub and operably coupled with a motor for rotating the drum, the drum at least partially defining a treating chamber for receiving laundry for treatment according to a cycle of operation, and a treating chemistry dispenser comprising multiple treating chemistry cups configured to dispense treating chemistry to the treating chamber; the method comprising:

performing a first wash cycle comprising a cold wash liquid comprising a mixture of water and a first dose of treating chemistry from one of the treating chemistry cups, filling to a first level of water, and washing for a first amount of time;

receiving at a controller a user selection of an activation of a performance enhancement selector; and upon activation of the performance enhancement selector, activating a second wash cycle comprising a mixture of water and a second dose of treating chemistry from another of the treating chemistry cups, filling to a second water level, and washing for a second amount of time.

10. The method of claim 9, further comprising receiving at a user interface a user selection of a preprogrammed wash cycle.

11. The method of claim 10, wherein selection of the preprogrammed wash cycle implements washing parameters of the first wash cycle.

12. The method of claim 11, wherein the second wash cycle occurs after a completion of the first wash cycle.

13. The method of claim 9, wherein the second wash cycle is a hot liquid wash cycle.

14. The method of claim 9, wherein the second wash cycle is longer than the first wash cycle.

15. The method of claim 9, wherein the treating chemistry cups include a bleach cup, a detergent cup, and a fabric softener cup.

16. The method of claim 15, wherein the bleach cup is configured to function as the another of the treating chemistry cups.

17. The method of claim 9, further comprising changing a wash cycle parameter of the first wash cycle upon activation of the performance enhancement selector.

18. The method of claim 17, wherein the wash cycle parameter includes one of an amount of water, water temperature, wash time, spin/tumble time, and agitator/tumble speed.

19. The method of claim 9, further comprising activating a turbidity sensor in the laundry treating appliance to measure a turbidity of the wash liquid during the first wash cycle.

20. The method of claim 19, further comprising starting the second wash cycle based on preprogrammed measured turbidity characteristics of the first wash cycle.

* * * * *